US005997018A

United States Patent [19]

Lee

[11] Patent Number: 5,997,018

[45] Date of Patent: Dec. 7, 1999

[54] ALL TERRAIN SPORT BOARD AND STEERING MECHANISMS FOR SAME

[75] Inventor: Jason Lee, Colorado Springs, Colo.

[73] Assignee: MountainBoard Sports, Inc., Colorado Springs, Colo.

[21] Appl. No.: 08/796,714

[22] Filed: Feb. 6, 1997

Related U.S. Application Data

[63] Continuation-in-part of application No. 08/239,862, May 9, 1994, abandoned.

[51] Int. Cl.[6] ..... A63C 17/02

[52] U.S. Cl. ..... 280/87.042; 280/11.28

[58] Field of Search ..... 280/87.041, 87.042, 280/11.27, 11.28, 11.19; 267/292

[56] References Cited

U.S. PATENT DOCUMENTS

| | | | |
|---|---|---|---|
| D. 49,395 | 7/1916 | Morgan . | |
| D. 252,346 | 7/1979 | Solheim . | |
| D. 252,347 | 7/1979 | Solheim . | |
| D. 293,340 | 12/1987 | Heilig . | |
| D. 302,993 | 8/1989 | Heilig . | |
| 2,032,657 | 3/1936 | Frederickson . | |
| 2,531,933 | 11/1950 | Clark . | |
| 3,331,612 | 7/1967 | Tietge | 280/11.28 |
| 4,120,508 | 10/1978 | Brown et al. | 280/11.28 |
| 4,159,121 | 6/1979 | Spitzke . | |
| 4,166,519 | 9/1979 | Maloney . | |
| 4,168,076 | 9/1979 | Johnson . | |
| 4,183,546 | 1/1980 | Heilig . | |
| 4,398,734 | 8/1983 | Barnard . | |
| 4,738,456 | 4/1988 | Creason . | |
| 4,773,239 | 9/1988 | Lowe et al. . | |
| 4,943,075 | 7/1990 | Gates . | |
| 4,951,958 | 8/1990 | Chao . | |
| 5,026,088 | 6/1991 | Stuart . | |
| 5,221,111 | 6/1993 | Younger . | |
| 5,263,725 | 11/1993 | Gesmer et al. . | |
| 5,356,159 | 10/1994 | Butterfield . | |

FOREIGN PATENT DOCUMENTS

| | | |
|---|---|---|
| 2 225 990 | 10/1989 | United Kingdom . |

*Primary Examiner*—Richard M. Camby
*Attorney, Agent, or Firm*—Graham & James LLP

[57] ABSTRACT

An all-terrain sport board especially adapted for riding on rough out-door terrain employing large pneumatic wheels, a large frame and a spring steering mechanism that enables a rider to tip the board and turn the wheels to a much greater degree than would be possible with a conventional boards. The steering mechanism provides polymeric shock absorbers of varying configurations to enhance the ability of the rider to make athletic maneuvers and jumps with the board without undue turbulence in the ride.

9 Claims, 12 Drawing Sheets

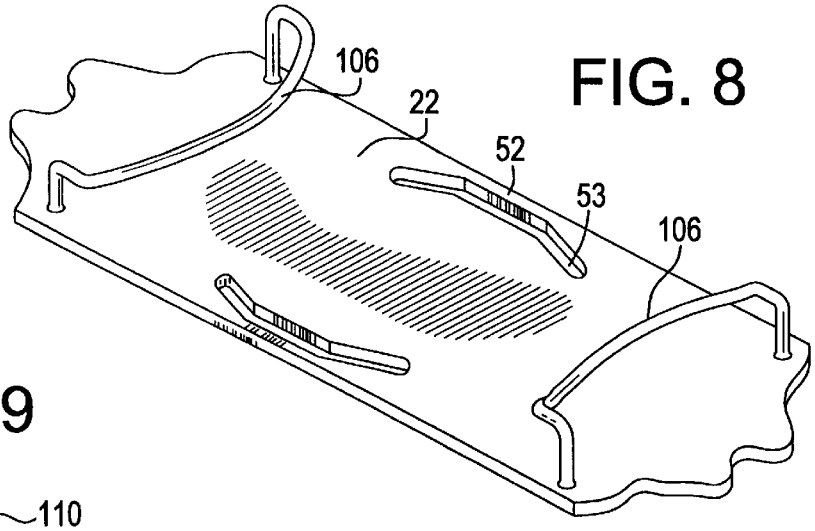
FIG. 8
FIG. 9
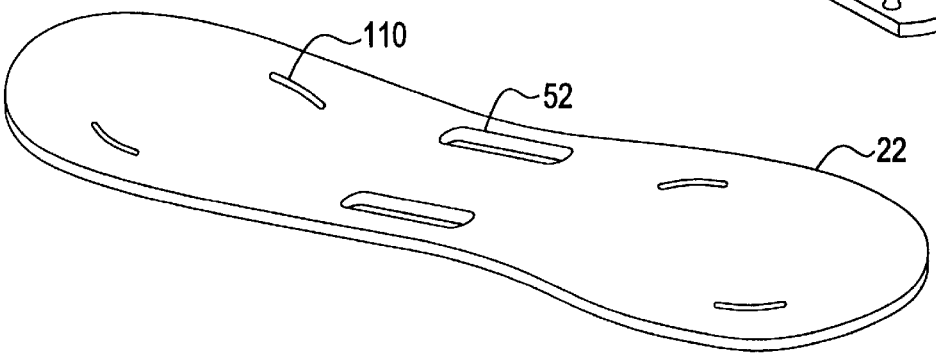
FIG. 10
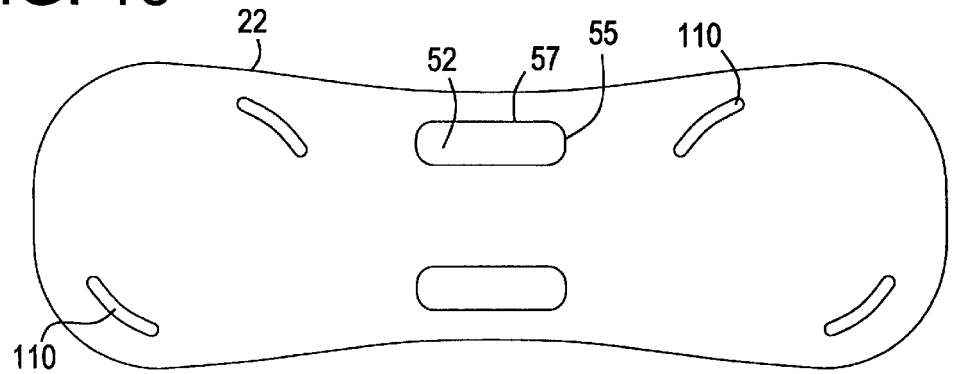
FIG.11
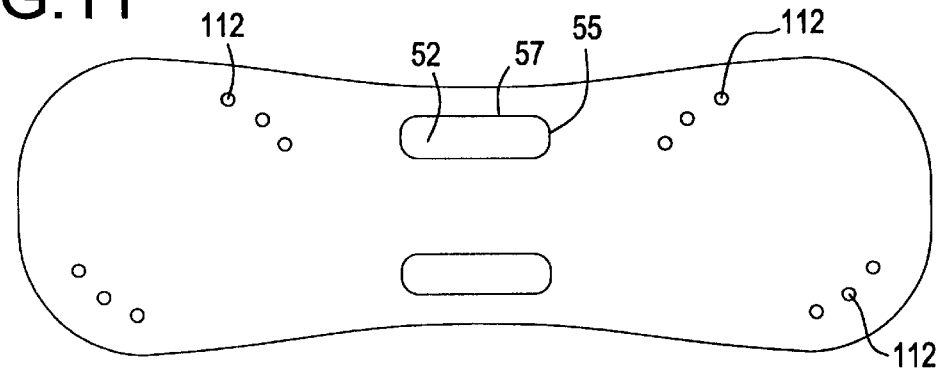

ALL TERRAIN SPORT BOARD AND STEERING MECHANISMS FOR SAME

This application is a continuation-in-part of application Ser. No. 08/239,862, filed May 9, 1994, now abandoned, which is incorporated herein by reference.

This invention relates to all-terrain boards. An all-terrain board, also known by its acronym, "ATB", is a relatively new type of sporting equipment, somewhat similar in nature to a skate board, but which can be ridden on all forms of terrain, including the roughest of terrain found on mountains, hills, valleys, rough and rocky roads, dirt roads, as well as grassy terrain and sand. ATBs can also be ridden on paved streets, but are built to enable the rider to conquer all forms of land terrain. ATBs are often ridden on the mountains of ski and snow board resorts during the spring, summer and fall when there is little or no snow, and thus provide resort operators and their customers with an exciting off-season sport.

Skate boards have grown popular as a form of sport and recreation. However, because of its relatively light-weight and solid wheel design, the skate board usually limits the rider to the smooth streets, driveways, and sidewalks, found in urban and suburban areas. In addition, skate boards do not have a means of enabling riders to stay engaged with the skate board deck while airborne; they are less safe, and cannot be easily ridden on rough forms of terrain.

The skate board prior art does not teach the features and advantages of the applicant's steering truck mechanisms and bindings for use with sport boards to be used on rough and rocky terrain. For example, U.S. Pat. No. 5,263,725 to Gesmer et al. discloses a dual spring mechanism, but Gesmer et al. does not disclose other features of the present invention, for example, the applicant's interior channel truck assembly, a top hat style spring retainer means, the inventive bindings, or shock absorbers. In addition, U.S. Pat. No. 4,398,734 to Barnard discloses a truck design for a skate type device, but Barnard does not disclose applicant's designs. In addition, the bindings in the snow board art differ greatly from applicant's designs and do not have the same advantages. See, for example, U.S. Pat. No. 5,356,159 to Butterfield and U.S. Pat. No. 5,026,088 to Stuart.

Since it is designed to be ridden on all forms of terrain, an all-terrain board is generally heavier and must be more durable than most other board-sport devices, such as skate boards and snow boards. In addition, all-terrain boarding is a very athletic, and a growing competitive, sport. ATB riders use the inclines and mounds found in uneven and rough terrain to jump and ride airborne, similar to that which a snow board rider might do. ATB riders may also ride at significant speeds, make sharp turns, and fast or sudden stops, and have developed various techniques, such as power slides and foot drags, for turning, stopping, accelerating and decelerating, and navigating the ATB over various forms of terrain. They also employ different stances on the board deck while riding. In sum, ATBs have become a means for sport riding on rough terrain and down mountains that lack snow, all-terrain boarding has become a sport unto itself, and beyond that known to skate boarders and snow boarders.

For these reasons, ATBs are designed and constructed in a manner much different than skate boards and snow boards. ATBs usually have a larger or more wide deck than skateboard, which deck can be mounted on a metal frame, and pneumatic rather an solid tires. They also have different truck mechanisms for steering and absorbing the shocks of rough terrain, and bindings for securing the rider's feet to the board. The type of terrain encountered when all-terrain boarding requires that the board's steering or truck mechanisms be both durable and highly flexible. It is advantageous to maximize the boards turning radius. In addition, for both the ATB rider's safety and comfort, that her the board be able to absorb and withstand the shocks encountered on rocky terrain and when performing jumps and other athletic moves with the ATB.

OBJECTS AND STATEMENT OF THE INVENTION

One object of this invention is to provide an all-terrain board that can be ridden comfortably and safely on all forms of terrain.

Another object of this invention is to provide an all-terrain board which is highly responsive and controlled, even when the rider takes the ATB air borne or when rocky and rough terrain is encountered.

Another object of this invention is to provide truck mechanisms for sport boards and other wheeled devices that are at the same time durable and flexible.

Another object of this invention is to provide shock absorbers for sport boards and other wheeled devices that enable riders to negotiate rough and rocky terrain.

Still another object of this invention is to provide an all-terrain board that can be ridden at significant speeds, and enable the rider to make sharp turns, and fast or sudden stops on various forms of terrain.

Various other objects, advantages, and features of this invention will become apparent to those skilled in the art from the following discussion, taken in conjunction with the accompanying drawings, in which:

BRIEF DESCRIPTION OF THE DRAWINGS

FIG. 8 is a perspective view showing an all-terrain board deck having a foot engagement means and an alternative handle style.

FIG. 9 is a perspective view showing an all-terrain board deck having hand openings and binding slots.

FIG. 10 is a top plan view of the all-terrain board deck of FIG. 9.

FIG. 11 is a top plan view of an alternative embodiment of an all-terrain board deck having hand openings and binding openings.

Figure 1:
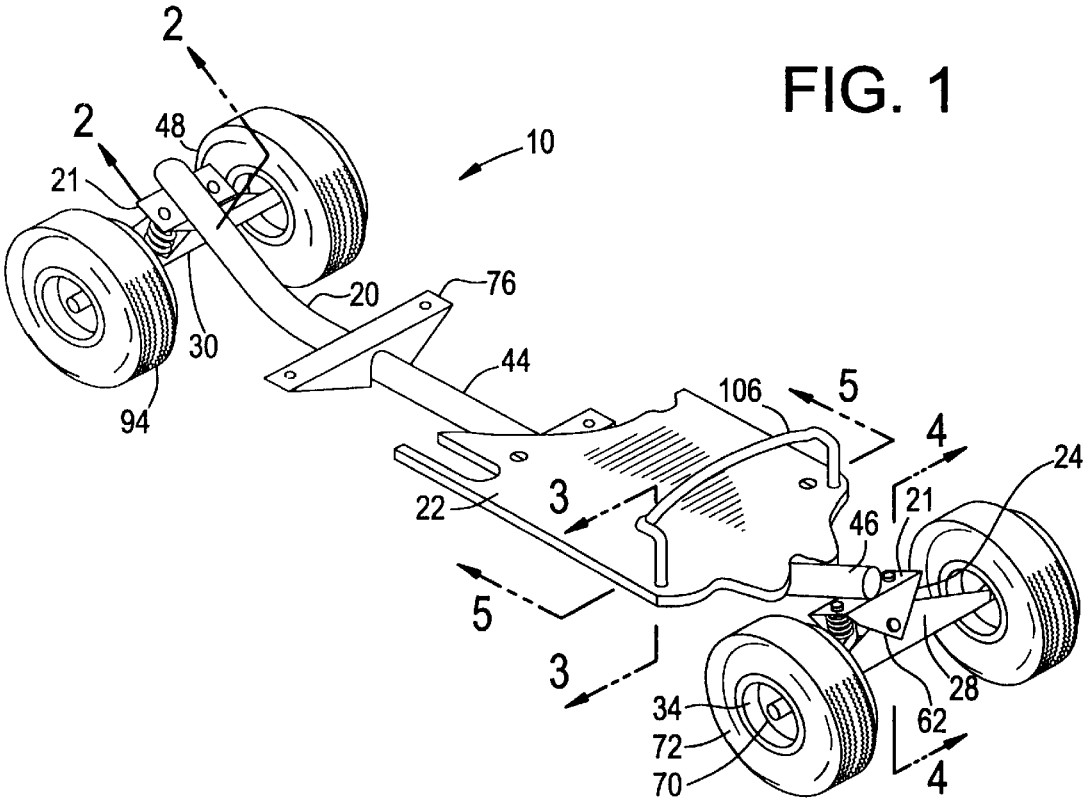
FIG. 1 is a broken away perspective view of an all-terrain board.

The following is a discussion and description of preferred specific embodiments of the all-terrain board of this invention, such being made with reference to the drawings, whereupon the same reference numerals are used to indicate the same or similar parts and/or structure. It is to be understood that such discussion and description is not to limit the scope of the invention.

DETAILED DESCRIPTION OF THE DRAWINGS

FIGS. 1 is an all-terrain board 10 having a frame 20. The frame 20 is preferably made from a metal or steel tube having a circular cross section. The frame 20 has a central portion 44 having cross support members 76 attached thereto. The cross support members 76 are preferably three in number with the center one being shorter in length than the outer two to allow the ATB 10 to be grasped. The ATB may also have just two cross support members 76, with one member located near each end of frame central portion 44, and no center member. Cross support members 76 may be attached to frame 20 by welding. The central portion 44 of the frame 20 defines a plane which is parallel to the terrain (not shown). A front end portion 46 of the frame 20 extends forwardly and upwardly from the central portion 44, and a rear end portion 48 extends rearwardly and upwardly from the central portion 44.

Figure 2:
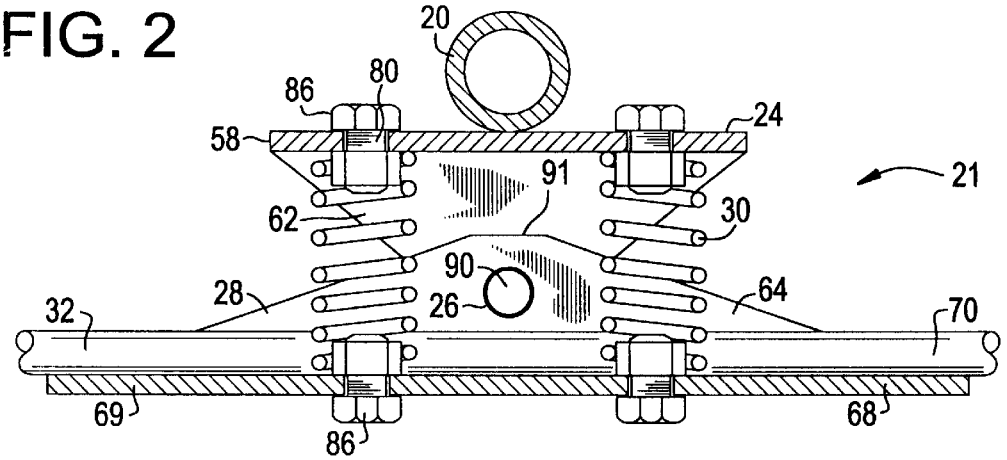
FIG. 2 is a cross-sectional view taken along lines 2—2 of FIG. 1 showing the truck steering mechanism.

Affixed to each end portion of frame 20 is a truck assembly 21 having an upper truck 24 and a lower truck 28. The upper trucks 24 extend downwardly from the end portions 46 and 48 of the frame 20, and they are secured to frame 20 by welding. As shown in FIG. 2, the upper truck 24 has an upper truck portion 58 which horizontally extends perpendicularly to the center line of an end portion 46 or 48 of the frame 20. The upper truck portion 58 has opposite ends each having a spring retention means, which in one embodiment is a threaded bolt 86 placed through openings 80. The threaded bolt 86 enables longitudinal adjustment within the spring 30. Alternatively, in place of a cylindrical spring retention means, a spring retention means which simply clamped on an end turn of the spring against the truck could be used. The spring retention means can also be a cylindrical stub of fixed length made of a polymeric or similar material, instead of a bolt.

As shown in FIGS. 1 and 2, a lower truck portion 62 of upper truck 24 extends downwardly from the upper truck portion 5 8. Lower portion 62 has a pivot pin or king pin opening 90 (see FIG. 2) which has a center line which extends outwardly, upwardly and which is laterally in alignment with respect to the center line of the central portion 44 of the frame 20. A pivot pin 26 extends through the opening 90 to secure the upper and lower trucks together.

Lower truck 28 has an upper truck portion 64 which also has a pivot pin opening 90 engaging the pivot pin 26, and a lower truck portion 68 extending horizontally and perpendicularly to the center line of an end portion of the frame. The lower truck portion 68 also has opposite lateral ends 69, each having a spring retention means which is a bolt 86 which may be adjusted longitudinally into the spring 30.

Figure 4:
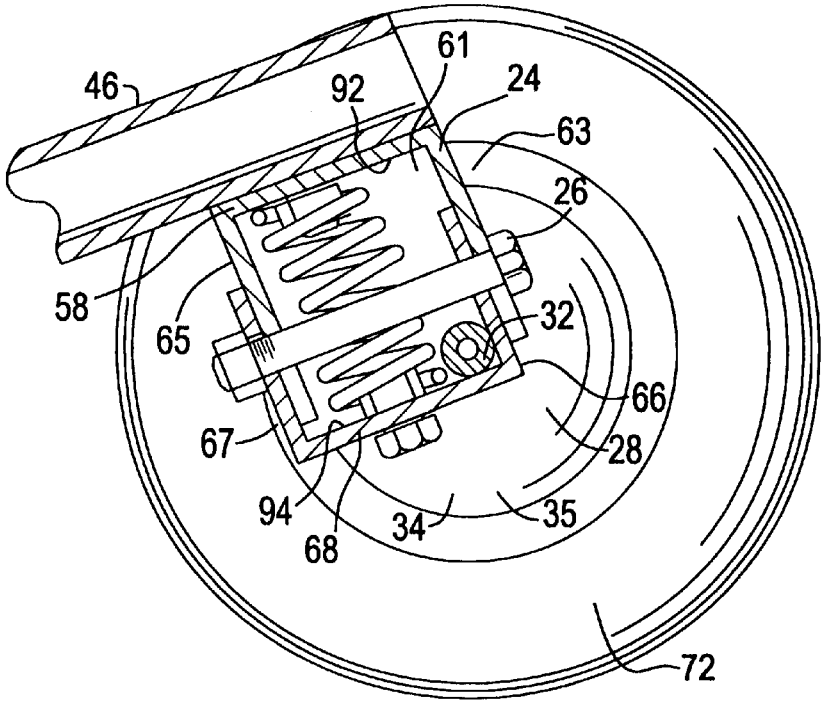
FIG. 4 is an enlarged cross-sectional view taken along lines 4—4 of FIG. 1 showing the steering mechanism.

FIG. 4 is an enlarged cross-sectional view taken along lines 4—4 of FIG. 1. As shown in FIG. 4, lower portion 62 of upper truck 24 has a front wall 63 and a back wall 65 extending downward from the upper truck portion 58 of upper truck 24. A ceiling is defined by the interior surface 92 of upper truck portion 58. Likewise, upper truck portion 64 of lower truck 28 has a front wall 66 and a back wall 67 that extend upward from lower truck portion 68 of lower truck 28. A floor is defined by the interior surface 94 of lower truck portion 68.

As shown in FIG. 4, upper truck 24 and lower truck 28 are joined together in an offset manner, that is, the exterior surface of front wall 66 of lower truck 28 abuts the interior surface of front wall 63 of upper truck 24, and the exterior surface of back wall 65 of upper truck 24 abuts interior surface of back wall 67 of lower truck 28. Upper truck 24 and lower truck 28 are secured to each other by means of the pivot pin 26 through pivot pin opening 90 which extends through front walls 63 and 66 and back walls 65 and 67. A bolt is used for a pivot pin 26. As shown, this assembly of truck "walls," "ceiling" and "floor" creates a strong and sturdy truck frame, which necessary for the riding conditions encountered by an all-terrain board, and thereby define an interior chamber or channel 61 within the upper and lower trucks that contains spring 30, spring retention means 86, and a portion of axle 32. The pivot pin's 26 longitudinal axis is parallel to the axis of the end portions 46, 48 of the frame 20 which is above it.

An axle 32 having opposite ends 70 is secured by welding to the lower portion 68 of the lower truck 28. It extends perpendicularly to the center line of the central portion 44 of frame 30 and parallel to the plane thereof.

Wheels 34 are rotatably mounted on opposite ends 70 of the axle 32. The wheels 34 have pneumatic tires 72 having a tread 94 which is chosen to suit the terrain the all-terrain board 10 is being used on. A knobby tire has been found to work best in dirt, a tire having a linear tread is best for streets, and a tire having no tread is best on sand, stone and other smooth surfaces. Preferably the tires 72 are mounted on a 2 piece nylon hub 35.

In use, when a rider tips a side of the frame 20 downwards, by placing pressure or load on one side of deck 22, the upper and lower trucks relatively rotate about the pivot pin causing the all-terrain board to turn in the direction of the downwardly tipped side of the ATB.

Figure 3:
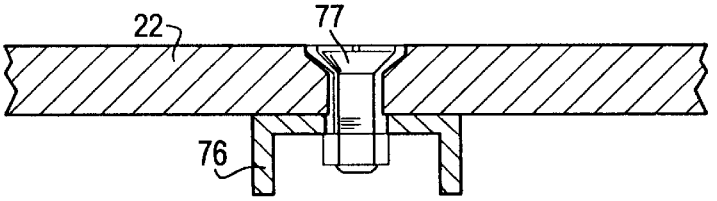
FIG. 3 is a cross-sectional view taken along lines 3—3 of FIG. 1.

The all-terrain board deck, or planar member, 22 is preferably made of ¾ inch wood. Depending on the strength and quality of the material, deck 22 can also be ¼ or ½ inch thick. It is sealed and has gripping strips or tape (not shown) attached thereto. FIG. 3 shows that the mounting of deck 22 on the cross support members 76 is accomplished with a bolt 77. FIG. 3 also shows that the cross support members 76 are preferably U-shaped in cross-section having 3 exterior flat sides.

The trucks may be made from 2 inch channel. One size of spring which was found to be effective was 2.25 inch long and one inch in diameter. Spring strength can be adapted to the weight and the ability of the rider. In an alternative embodiment (not shown) the truck is extended in width sufficiently to accommodate 4 springs, two on each side of the pivot pin. Springs were found to be preferable to the use of a rubber-only medium in the ATB truck because of their greater extension and compression which allowed for sharper and quicker turns. Using springs in the trucks enabled a large board, with large wheels, to be maneuverable. The extent of that maneuverability was here before unavailable.

Figure 5:
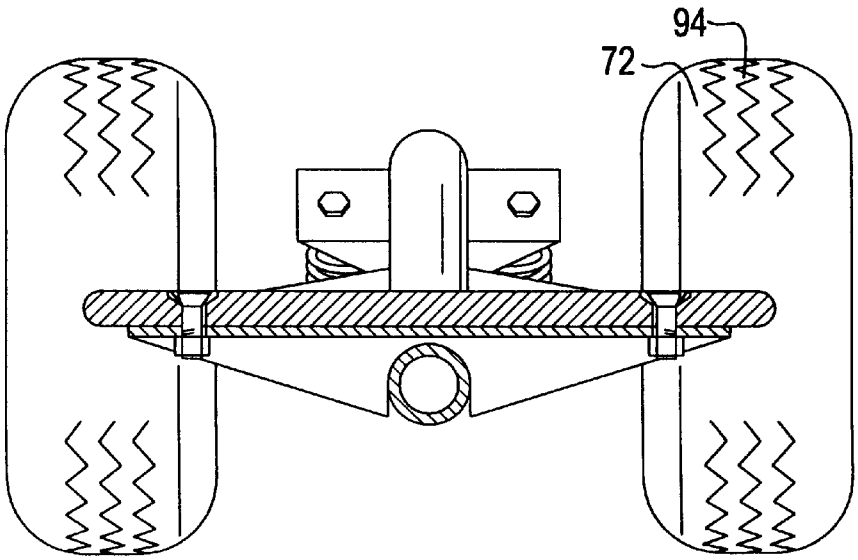
FIG. 5 is an enlarged cross-sectional view taken along lines 5—5 of FIG. 1.
Figure 6:
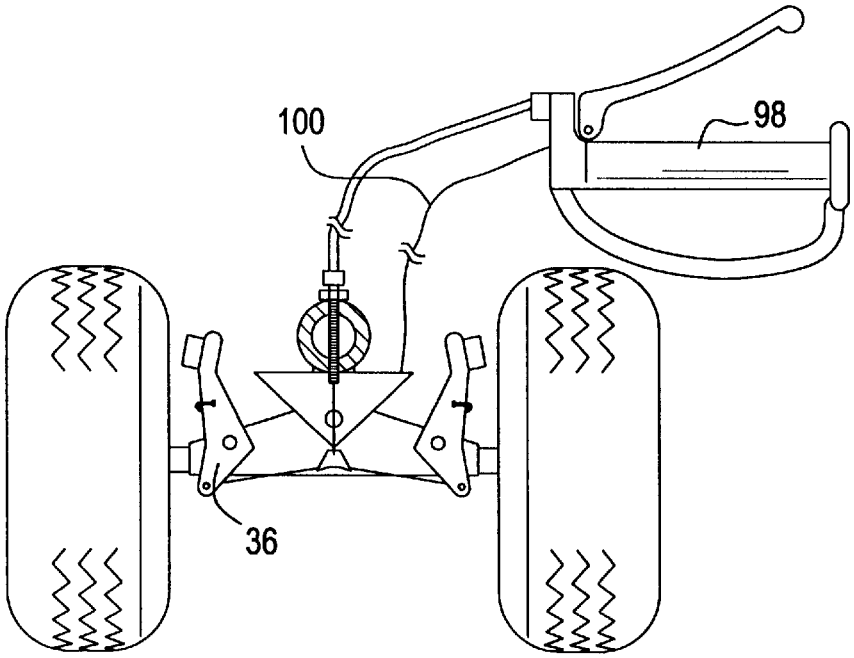
FIG. 6 is an end view of the invention having a board retention loop and a hand operated brake mechanism.
Figure 7:
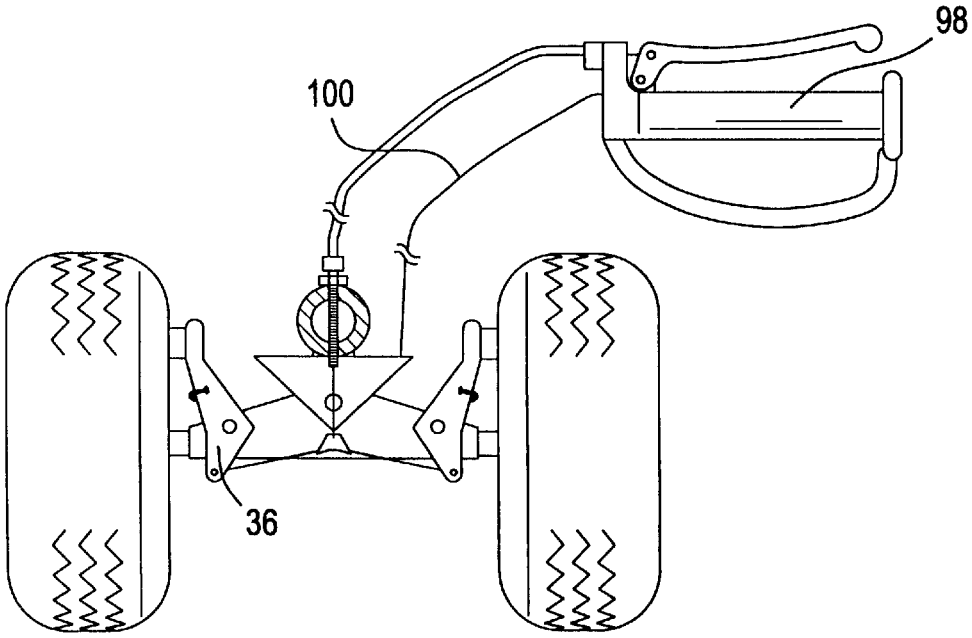
FIG. 7 is an end view, similar to FIG. 6, but showing the brake in an engaged position when the handle is squeezed.

FIG. 5 is a cross-sectional view taken along line 5—5 of FIG. 1. FIG. 6 shows an optional brake mechanism 36 having a hand control 98. A board retention loop 100 is also shown. This loop 100 retains the moving ATB 10 when a rider falls. FIG. 7 shows the brake mechanism 36 in an engaged position when the hand control 98 is squeezed.

FIG. 8 shows one alternative embodiment of deck 22. The openings 52 for a rider's hand 52 in this embodiment have an end portion 53 which slopes towards the center line of the all-terrain board 10 on a 45 degree angle. This allows the ATB 10 to be carried in a tilted position when the rider's hand is inserted through the end portion 53 of the opening. FIG. 8 also shows one alternative binding or foot engagement means 106 which is formed from a metal rod and mounted on opposite sides of the top side of deck 22. The upper portion of this inverted U-shaped binding 106 is bent towards the center of the length of the board so that when a rider is standing on the board he may partially slide his foot under the foot engagement means. The board is engaged by the rider's foot sufficiently to lift it if he jumps, but not sufficiently to hold it if he falls.

FIGS. 9 to 11 show still further and preferred embodiments of all-terrain board decks 22. The openings 52 for a rider's hand in these embodiments are cut to form substantially parallel edges 57, relative to the center line of the board, but have curved end edges 55 for comfortable handling. This handle design allows the ATB 10 to be easily lifted and carried along the side of a rider, much like a suit case or brief case, when the rider's hand is inserted through opening 52.

Figure 12:
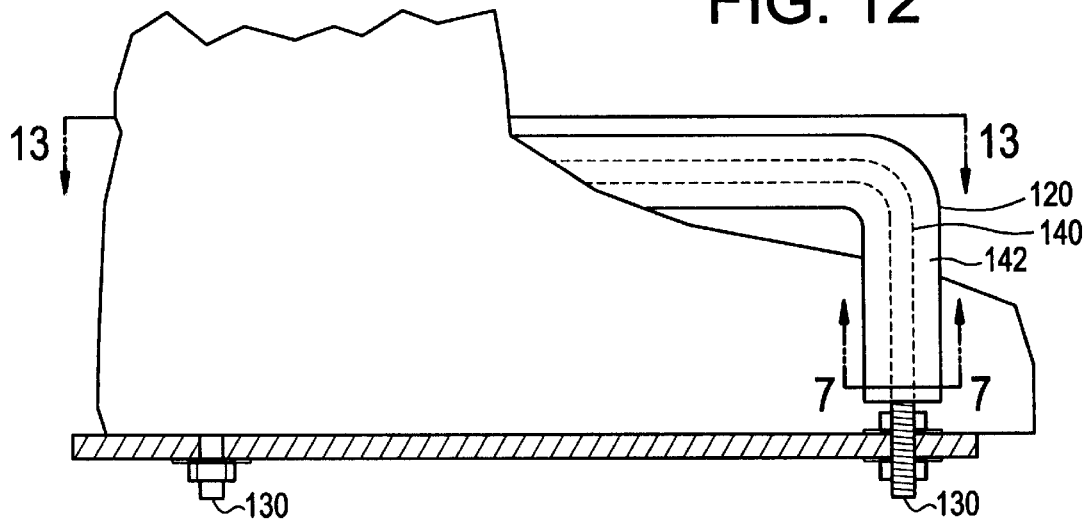
FIG. 12 is a cross section view of the all-terrain board of this invention with a binding mounted on the deck.

FIGS. 9 and 10 also show four slots 110 cut into the deck 22 for securing alternative foot engagement means, or bindings 120, described below. The slots 110 allow for varying the placement of a binding 120 on deck 22 because the space defined by the slot edges covers more area on deck 22 than is needed to accommodate the threading 130 of binding 120. In the alternative, circular openings 112 may be cut into the deck at about the same positions where the slots would be cut, as is shown in FIG. 11. A number, preferably three, of openings 112 for each position on deck 22 should be made so as to permit a variation of binding placement like that achieved by the use of slots 110. The size of the openings should be enough to accommodate thread 130, and yet achieve a tight fit of binding 120 to deck 22. As shown in FIG. 12 the ends of binding 120 are secured to deck 22 by means of a threading 130 which is placed through slots 110 or openings 112 and then bolted to deck 22. Threading 130 extends from the inner core 140 of binding 120, which is described more fully below. Threading 130 is also extended more than is necessary for general mounting to allow for the adjustment of the height of the binding above the deck, which in turn allows the rider to adjust the fit of his or her foot in the binding.

Figure 13:
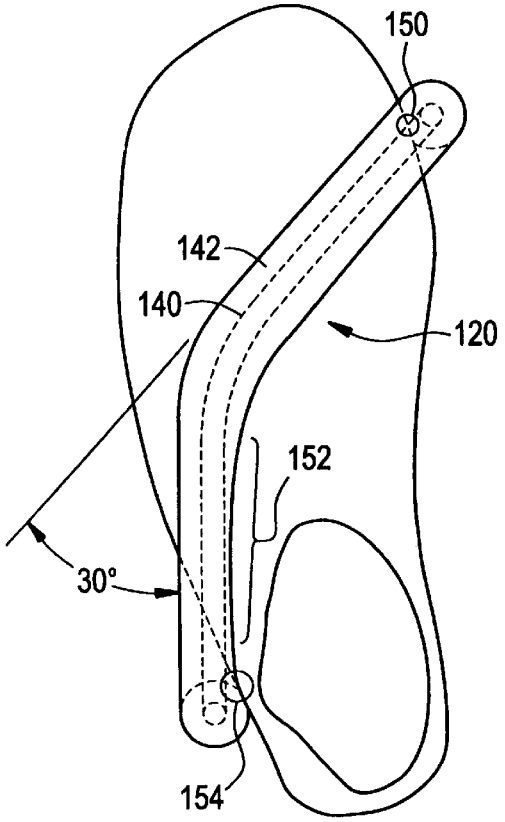
FIG. 13 is a cross section perspective view of the ATB foot binding of this invention showing pressure or binding points on the foot of a rider.
Figure 15:
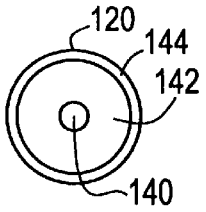
FIG. 15 is a cross section view of the ATB binding of this invention showing the various layers of the binding.

As shown in FIGS. 12, 13 and 15, the bindings 120 of this invention are preferably constructed of one or more inner metal or steel rods 140, or other sufficiently hard or stiff material, surrounded by a first layer 142 made of rubber, polymeric, or similar material that assists in achieving the secure fit provided by the binding design by squeezing between the foot and the inner rod 140, and which also provides a supportive cushion between the inner rod and the rider's foot. The rubber or plastic layer also serves to absorb some of the impact load and shock associated with riding the board on rough terrain and rocks. As shown in FIG. 12, the inner core extends to threaded portion 130, which is exposed beyond the binding sheath so as to enable the binding to be bolted to the deck. More than enough length of threading is provided so as to adjust the height of the binding relative to the board surface. As shown in FIG. 15, in an alternative embodiment of binding 120, one or more additional layers or skins 144 of a material different than first rubber or polymeric layer 142 can be placed around the first layer to form a laminate. The additional layers can be neoprene, leather, or similar materials.

Figure 14:
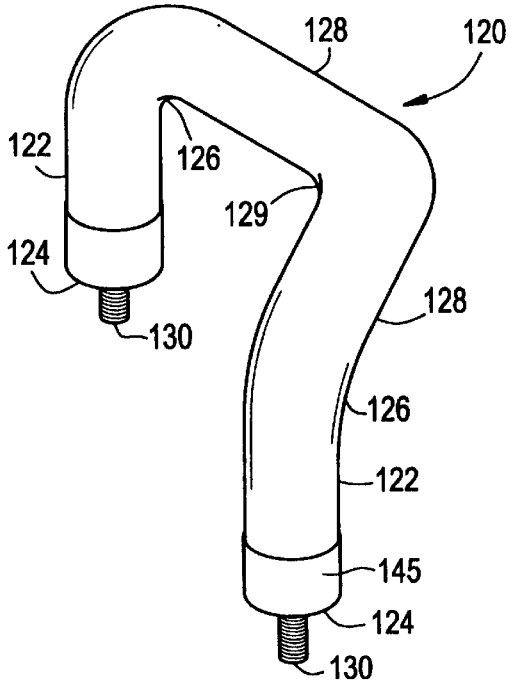
FIG. 14 is a three dimensional perspective view of the ATB binding of this invention showing the curves of the binding.
Figure 16:
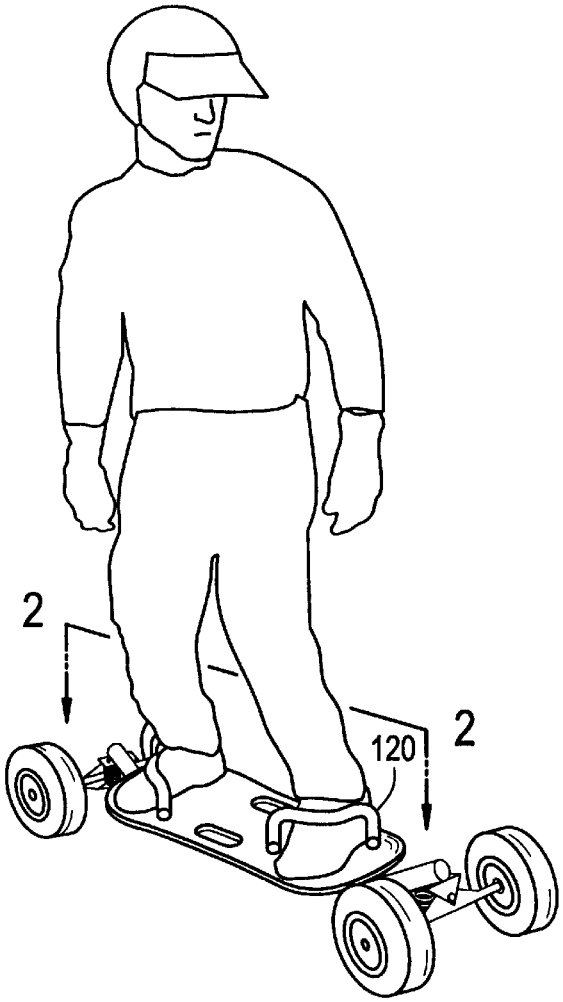
FIG. 16 is a perspective view of the all-terrain board of this invention with a rider standing thereon.
Figure 17:
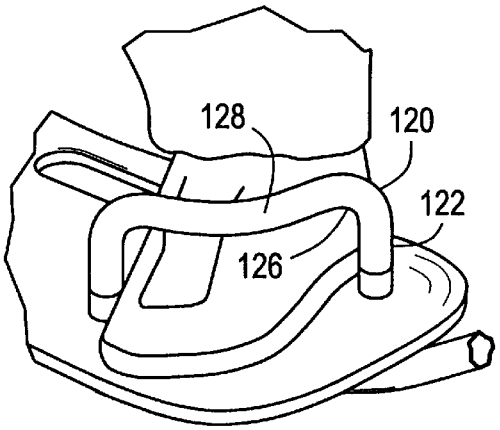
FIG. 17 is an enlarged partial view of FIG. 16 showing the left foot of the rider engaged with the binding.

FIG. 16 shows a rider, standing on the deck of an all-terrain board of this invention with his feet secured by bindings 120. In this figure, the rider is leading with the left shoulder along center line 2—2, and is looking in the direction the ATB will go when in motion. As shown in FIGS. 14, 16, and 17, the bindings 120 have two post or vertical portions 122 each having a base 124 to be mounted on deck 22. Vertical portions 122 extend upwards to first curved or beveled portions 126. First beveled portions 126 extend outward at an angle in relation to the vertical portions to a horizontal portion 128 which has a second beveled portion 129 at about its midpoint.

As shown in FIG. 14, beveled portions 126 extend outwardly at an angle relative to the center line of vertical portions 122, to form a beveled horizontal portion 128, which can be seen down along lines 5—5, the beveling of the horizontal portion 128 being placed at about the midpoint 129 of horizontal portion 128. As described more fully below, this dual-curved design is such that when the side of the rider's foot is flush with, or in very close proximity to, one of the first vertical portions 122, the binding secures the rider's foot by engaging it in three areas: at the two sides of the foot, and at the top of the foot.

FIG. 13 is a cross sectional perspective of binding 120 with a rider's foot fully engaged with the binding, and showing the various pressure points 150, 152 and 154, where the binding engages and secures the rider's foot. As shown in this figure, which depicts the binding securing the rider's left foot, there are three pressure points: (1) At the vertical portion 122 adjacent to the big toe of the rider, the binding 120 has a pressure area 150 where the rubber of the binding squeezes between binding inner core 140 and the inside of the rider's foot, preferably at about the big or first toe; (2) At the horizontal portion 128 over the top of the rider's foot there is a second pressure area 152, indicated by the curved line, where the rubber of the binding squeezes between the inner metal core and the top of the foot, preferably on the left area of the top of the foot; and (3) At the vertical portion 122 adjacent to the outside of the ankle, there is a third pressure point 154 where the rubber squeezes between the inner metal core and the outside of the rider's foot, preferably on the side of the heel just below or above the ankle bone.

Figure 18:
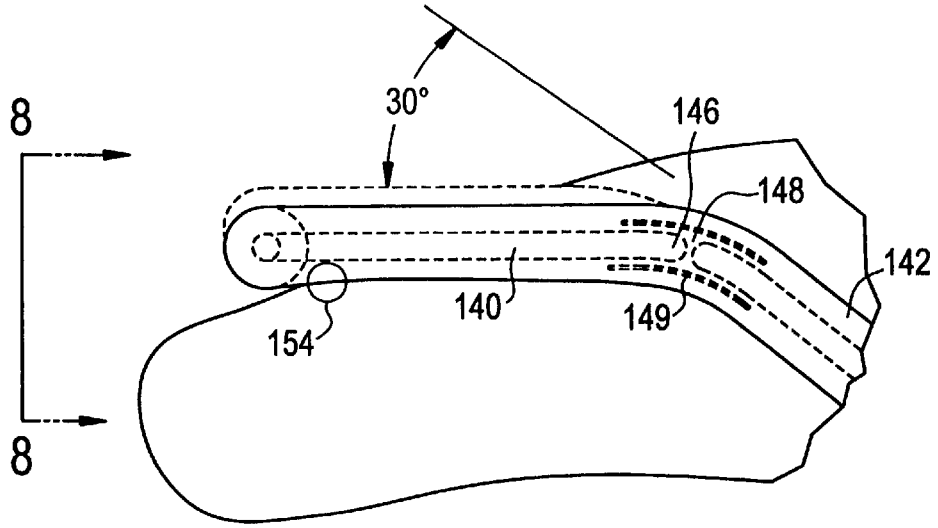
FIG. 18 is a cross section of the ATB binding of this invention showing a two-part inner metal core.

These triangular or three-point areas of squeezing and pressure on the two opposing sides of the foot, and on the top of the rider's foot opposite deck 22, which are created by a design having curved surfaces to cover specific areas of the foot where it is efficient to apply opposing points of pressure, work in combination with the binding's inner core 140 and surrounding rubber layer 142, to "lock-in" the rider's foot to the board. Once the foot is locked in, the rider can execute very athletic maneuvers, including those that take the all-terrain board into the air, without losing control of the board. The "lock-in" fit provided by the binding 120 can also be adjusted to accommodate variations in the anatomy of a particular foot by changing the angle of the curve of center rod 140 to create a custom contour that comfortably accommodates the anatomy of the rider's foot. As shown in FIGS. 13 and 18, the angle formed by the juxtaposition of metal core portions 140, or by bending the metal core in the case where it is one solid piece, is about 30 degrees. The preferable range for this angle is about 30 to 50 degrees, and the angle can be adjusted by placing the binding in a vise, or by similar means of bending metal.

Figure 19:
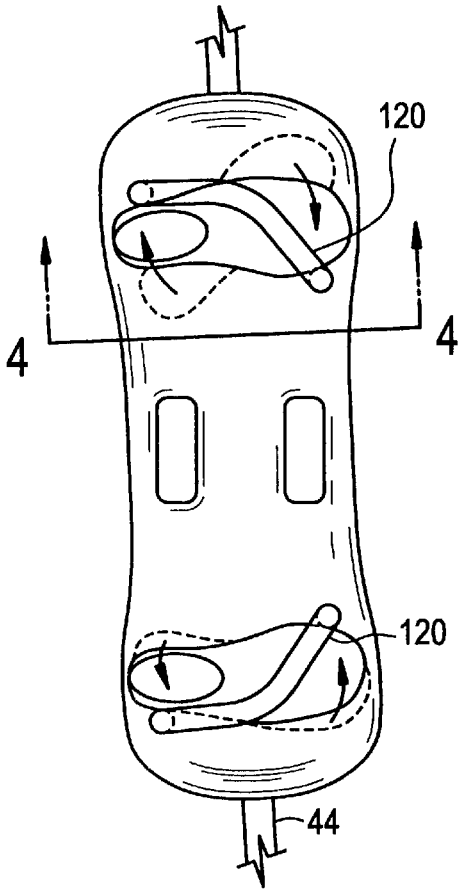
FIG. 19 is a plan view of the ATB deck showing a rider's feet locking into the ATB bindings.

Taking advantage of the "lock-in" fitting attribute of the applicant's bindings is relatively simple. As shown in FIG. 19, to engage the binding, the rider places his or her feet on the board into the space defined by binding 120 and the top surface of deck 22. Then, the rider slightly rotates or twists the right foot to the left, or counter-clock wise, and the left foot to the right, or clockwise, in order to tighten the engagement between the foot and the binding and create the three pressure points 150, 152, and 154, described above. When this is done, the rider's feet are essentially "locked-in" to the bindings and the rider can jump and take the board into the air. However, if the speed and roughness of the ride is not too great, the applicant's binding design is such that one or both of the rider's feet do not have to be fully engaged with, or locked-in, the binding 120 at all of the pressure points. When the feet are not fully engaged with the bindings, it is difficult for the rider to jump and take the board into the air. However, the rider may still make turns on the terrain surface. In addition, for beginner ATB riders, it is preferable to "lock in" only one foot to a binding 120. More advanced riders will fully lock into the bindings so as to take the ATB airborne whenever the opportunity arises. To disengage from the binding, the rotation or twisting of the feet is simply done in the reverse direction, the right foot is rotated slightly to the right, and the left foot is rotated slightly to the left, and the rider is free to pull out his feet and hop off the board.

The curved design of binding 120, together with its metal core, and rubber outer-layer, results in a binding that achieves a comfortable but firm, or ergonomic, fit with the rider's foot, and yet at the same time lets the rider easily and quickly engage and disengage from the board. The metal core/rubber layered bindings of this invention are stiff but comfortable. The design of the present invention is superior to the "buckle in" or "step in" bindings used on snow boards, which are hard to disengage from when they are tightened and pressure from the foot is exerted on them. Although the bindings of the present invention were designed for use with applicant's all-terrain boards, they can also be used with skate boards, windsurfers, surfboards, and other types of sport boards.

A rider can mount the bindings onto the board in accordance with his or her own riding stance by securing binding ends at different locations in binding slots 110, or in different binding holes 112. This is important because each rider stands on the board differently. In addition, bindings 120 can be mounted on the deck in a symmetrical manner, as shown in FIG. 19, which enables the rider to switch to an opposite direction, without removing his or her feet from the deck, by simply turning the upper body to lead with the opposite shoulder. In the alternative, the bindings can be mounted asymmetrically, in the case, for example, where the rider wishes to lead only with the left shoulder.

Figure 20:
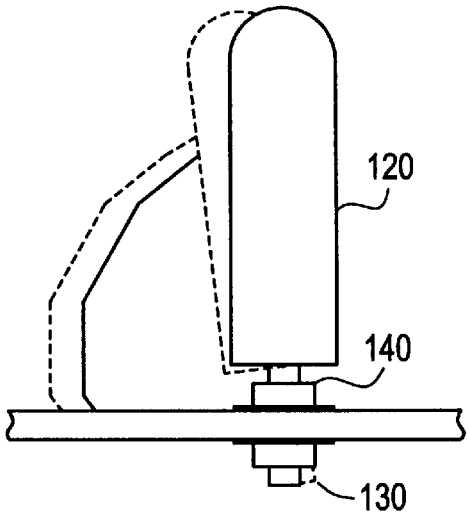
FIG. 20 is an enlarged partial view of a mounted ATB binding showing the flexibility of the bindings of this invention.

Turning again to the construction of binding 120, as shown in FIG. 18, the inner core 140 may be constructed in two separate portions, with end portions 146. The tips of curved end portions 146 are preferably placed in close proximity to each other, leaving a small gap 148 in between them. Gap 148 between end portions 146 gives the binding 120 added flexibility and give when the board is in use. A sleeve 149, preferably made of plastic or similar flexible material may be placed over end portions 146 to help keep them in alignment. In addition, as shown in FIG. 20, for additional comfort and sport ability, the inner core 140 should be of a flexible enough material, e.g., metal or durable plastic, to allow the binding some play or small forward movement when the rider's foot is engaged.

The inner core of the bindings of the present invention can be made from a 1045 steel rod having a length of about 16 inches and a diameter of about 5/16ths of an inch. About 1 1/4 inches of the rod is threaded at each end using conventional threading techniques. The threaded rod is then put into a bending jig or template, held in place, and then bent to create the various curves or beveled portions of binding 120 described above. The rubber outer core is sourced from rubber tubing with a hollow interior that is sized to match the outer diameter of the inner rod. A lubricant is used to slide the outer sheath over the rod. Vinyl end caps 145 can be placed at the bases 124 of binding 120 to provide a place for a product identification or trademark on the binding 120, or for purely decorative purposes. Nuts and washers, or similar hardware, are then placed on the threading 130 for securing the binding 120 to the deck 22.

Figure 21:
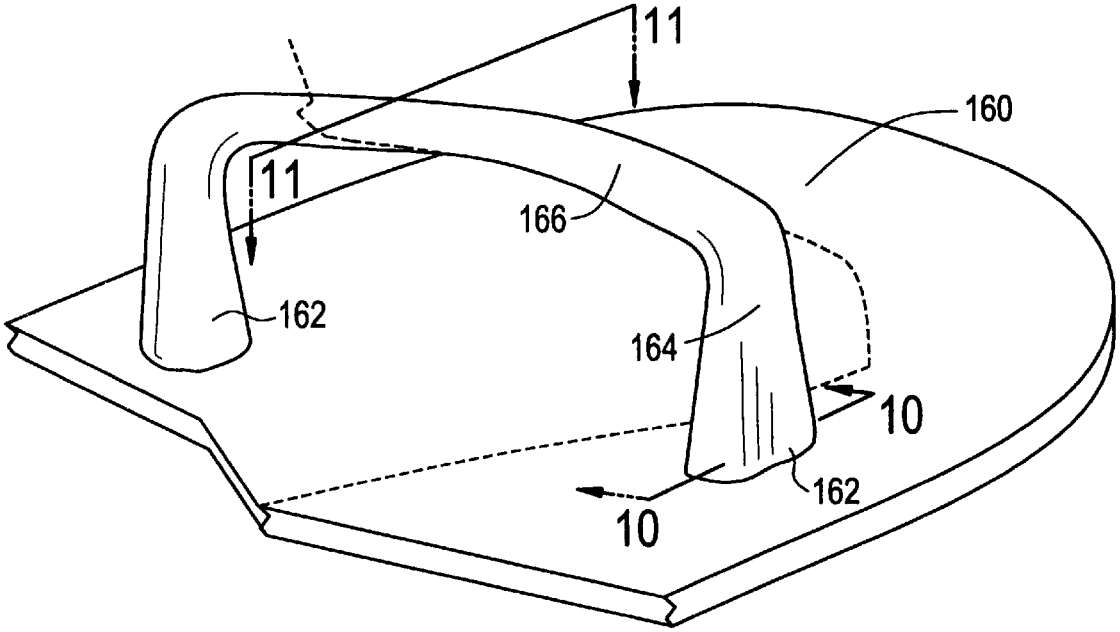
FIG. 21 is a perspective view of an alternative all-terrain board binding on the deck of the ATB.
Figure 22:
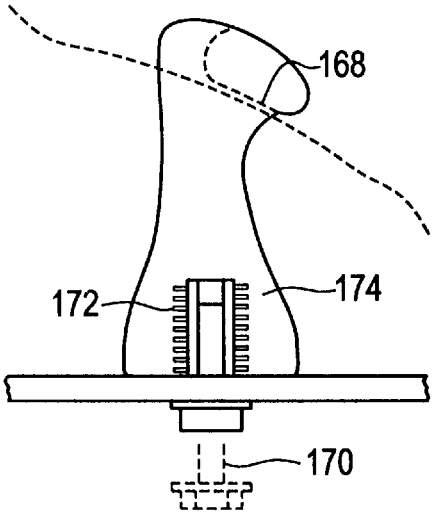
FIG. 22 is a cross section view of the ATB binding of FIG. 21 showing a binding profile.
Figure 23:
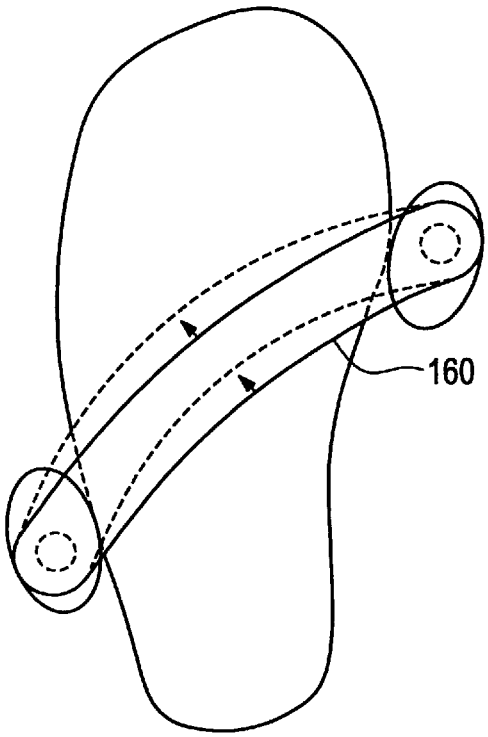
FIG. 23 is a plan view of the alternative ATB binding of FIG. 21 showing the flexibility of the alternative bindings of this invention.

FIGS. 21, 22, and 23, disclose a still further alternative embodiment of binding 120 that differs in that it does not have an inner metal core. This type of binding is molded from a rubber, plastic or other polymeric material whose durometer should enable the material to be malleable yet substantially rigid. As shown in FIG. 21, this binding embodiment 160 has a base portion 162 which extends upwards from deck 22 and narrows to side portions 164. A top portion 166 joins the side portions horizontally and is slightly curved to accommodate the rider's foot. As shown in FIG. 22, the underside of horizontal portion 166 is designed to conform to the rider's foot with an interior binding profile 168, that is shaped to correspond to the contour of the top of the foot. Base 162 is molded in the interior of binding 160 to form grooved insertions 174 which can receive and hold the prongs or knurls 172 of post 170. Post 170 should contain enough prongs 172, for example at least nine or ten, and prongs 172 should be durable enough to firmly secure the binding to deck 22. As shown in FIG. 23, alternative binding 160 should be flexible enough to have some play or small movement when secured to the deck.

Figure 24:
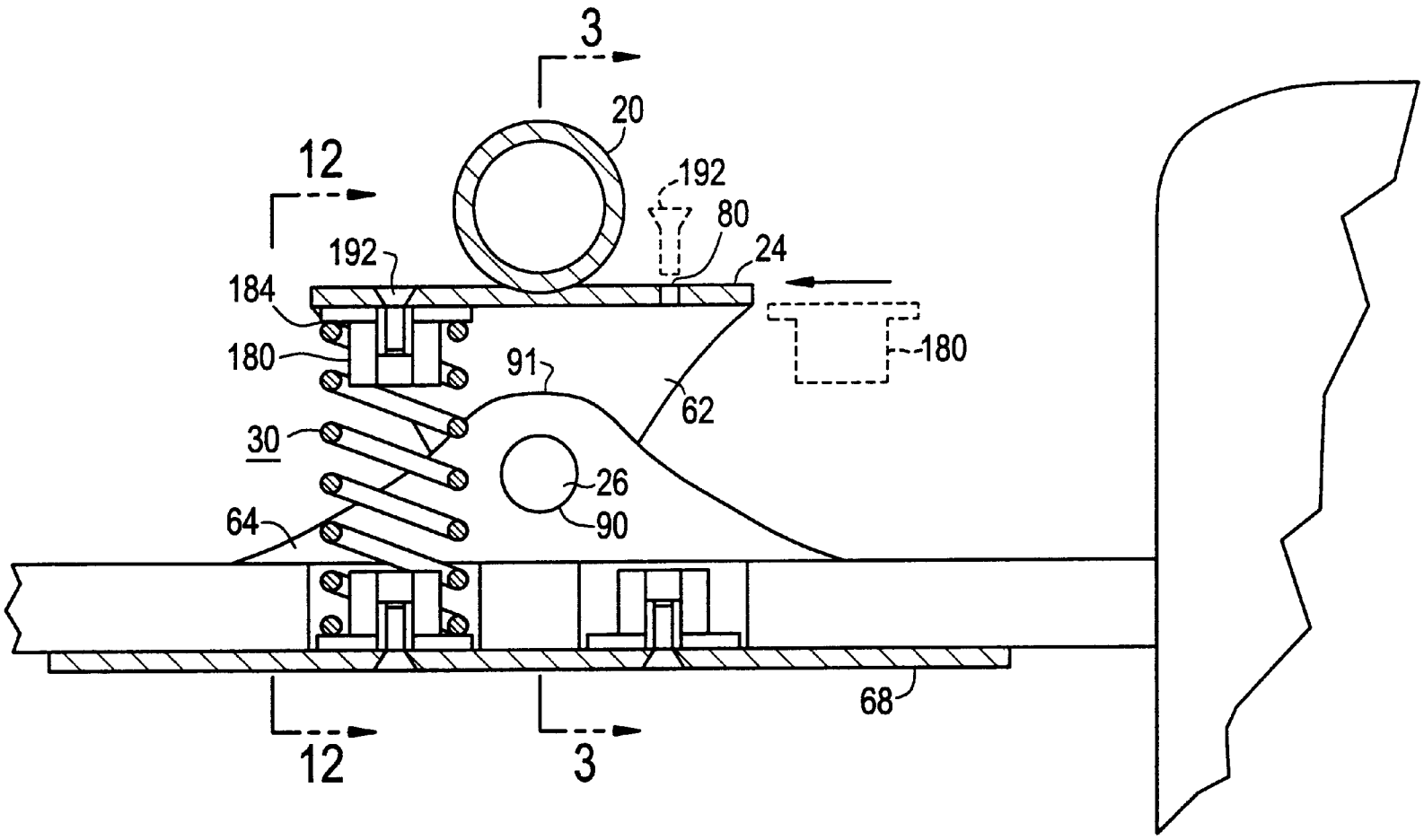
FIG. 24 is a cross section view of an alternative all-terrain board truck assembly of this invention.
Figure 25:
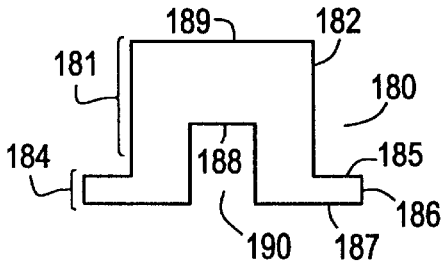
FIG. 25 is an elevational view of one spring retainer of this invention for use in a truck assembly.
Figure 26:
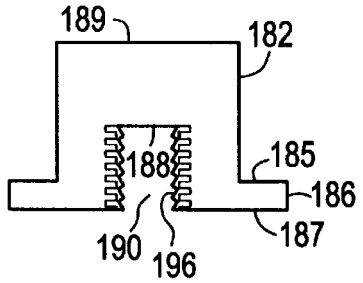
FIG. 26 is an elevational view of a spring retainer of this invention for use in a truck assembly having a grooved channel.
Figure 27:
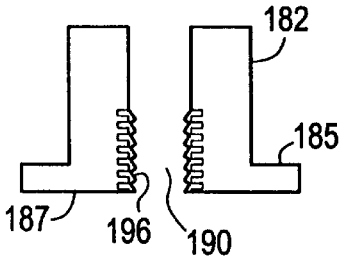
FIG. 27 is an elevational view of a spring retainer of this invention for use in a truck assembly having a grooved channel throughout the spring retainer.

In an alternative truck embodiment, the spring retention means in truck assembly 21 may be of a "top hat" style configuration, as shown in FIG. 24, and is made of a polymeric material, such as urethane. It can also be made of steel. This top hat retention means 180 has a cylindrical portion 181 attached to a rim portion 184, having an inner rim surface 185, an outer rim surface 186, and a top surface 187. Spring retainer 180 is molded, using conventional molding techniques, to have an interior opening or channel 190 therein to receive bolt 192, which secures top hat spring retainer 180 to upper truck portion 24 and lower truck portion 28 through openings 80. As shown in FIGS. 26 and 27, top hat interior opening 190 can be machined to contain grooves 196 to receive the threads of the bolt 192. Grooves 196 can also be formed into a brass or steel piece, so as to create a grooved insert, which can then be placed inside channel 190 by means of, for example, pneumatic pressure. The outside diameter of the grooved insert should be about the same as the diameter of channel 190. Interior channel 190 can also be molded to create grooves 196 to receive the threading of bolt 192.

Interior channel 190 can extend throughout cylindrical portion 181 to form two separate lower cylindrical portions 181, as shown in FIG. 27. Or, channel 196 can extend only partially through cylindrical portion 181 so as to form a unitary cylindrical portion 181 with an upper surface 188 and a lower cylindrical portion surface 189.

As shown in FIG. 24, when in place, springs 30 are situated in interior truck channel 61 as follows. The top and bottom of springs 30 rest on inner surfaces 185 of rim portion 184, and the first few turns of spring 30 from each end wrap around the outside surface 182 of cylindrical portion 181. The top surfaces 187 of rim portion 184 abut the interior ceiling 92 of upper truck portion 58 and interior floor 94 of lower truck portion 68 in the interior of truck channel 61. Bolt 192 is placed through top and bottom truck openings 80 to secure the top hat/spring assembly inside truck channel 61. Like that in the truck assembly of FIG. 2 described above, a pivot pin 26 extends through the opening 90 to secure the upper and lower trucks together and form interior channel 61. Upper truck 24 is then secured to frame 20 by welding, as in the embodiment of FIG. 2.

As can be seen by comparing the lower truck of the embodiment of FIG. 24 with FIG. 2, the truck styles may differ. Upper truck portion 64 of lower truck 28, see FIG. 2, has a flat surface 91. The corresponding surface in FIG. 4 is a rounded surface and forms a round truck. When surface 91 is an arched surface, rounded truck 21 has more rotational space. This enables the upper and lower trucks to move closely together during a turn to allow for a greater turning radius for the board. In addition, the rounded truck is also lighter.

Figure 31:
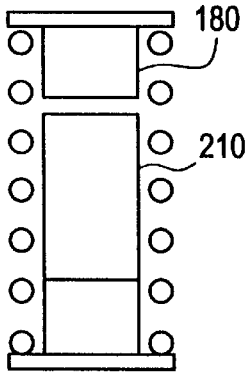
FIG. 31 is a partial view of the ATB truck's spring retainer/spring assembly of this invention having a cylindrical shock absorber inserted between the spring retainers.
Figure 32:
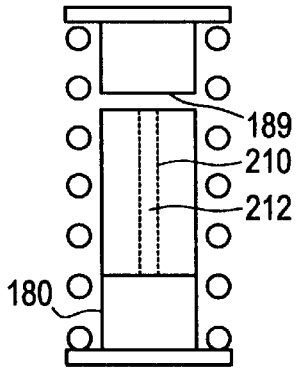
FIG. 32 is a partial view of the ATB truck's spring retainer/spring assembly of this invention having a cylindrical shock absorber with an interior channel therein inserted between the spring retainers.

In order to absorb the hard bumps and shocks associated with all-terrain board riding, and to provide a more controlled ride, cylindrical inserts 210, or shock absorbers, made of a plastic, rubber or polymeric material, e.g., urethane, may be placed inside of springs 30, and between spring retainers 180, for use in the ATB truck 21. As shown in FIGS. 31 and 32, the inserted shock absorber 210 rests on surface 189 of cylindrical portion 181 of lower top hat spring retainer 180, leaving a small amount of space between the insert and upper top hat spring retainer 180, when the board is at rest. More natural and smooth turning is achieved with the use of the shock absorber 210 of the present invention. Preferably, cylindrical shock absorber 210 contains an inner channel 212 which can be molded into the cylinder or machined therein, using conventional molding or milling techniques. The use of an inner channel 212 in shock absorber 210 results in a ride of even more precise resistance or smoothness than that obtained with a cylindrical insert having no channel therein. Cylindrical shock absorber 210 can be fabricated starting with a urethane, or other polymeric, rod or block, which is milled or cut to the desired size using conventional milling or cutting techniques; it can also be fabricated from a mold. In addition, the shock absorber does not have to be a cylindrical shape. For example, it can be rectangular or square, if the spring 30 interior accommodates such shapes.

Figure 33:
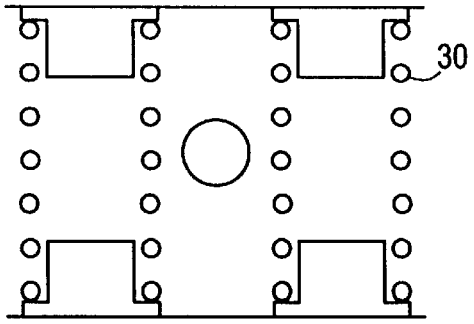
FIGS. 33 and 34 are partial views of the ATB truck's spring retainer/spring assembly of this invention showing the extension of the spring and movement of spring retainer when the ATB experiences load.
Figure 34:
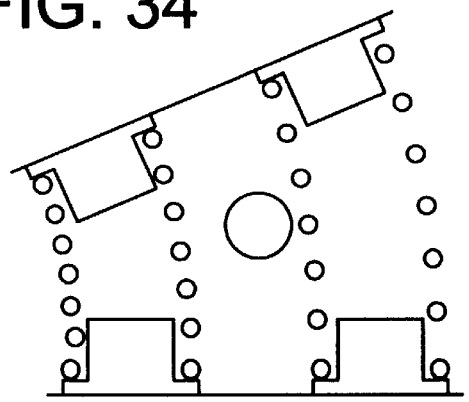

In one truck assembly embodiment, spring 30 is about two and one-half inches long, and spring retainer 180 is about three quarters of an inch to an inch long. Cylindrical shock absorber insert is cut to be shorter in length than springs 30. As shown in FIGS. 33 and 34, this combination of sizes for the spring 30 and spring retainer 180 is such that when one spring is fully loaded by the rider placing his or her weight on one side of the board, the other expands but also stays connected to inner rim surface 185 and outer cylindrical surface 182 of top hat spring retainer 180.

Figure 35:
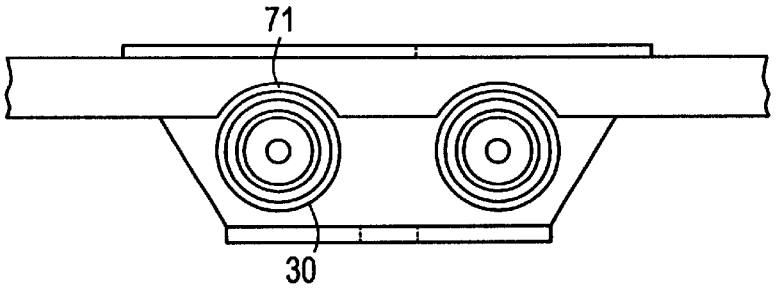
FIG. 35 is a plan view of an all-terrain board axle/spring assembly of this invention showing the axle having milled concave portions for accommodating a portion of the spring.

In addition, as shown in FIG. 35, to maintain a tight truck unit, and to save truck space and weight, axle 32 may be milled out to form concave enclosures 71 that partially encompass springs 30. By using a milled axle 32, lower truck portion 68 of lower truck 28 need not be so wide as to accommodate both axle 32 and springs 30 side by side.

Figure 28:
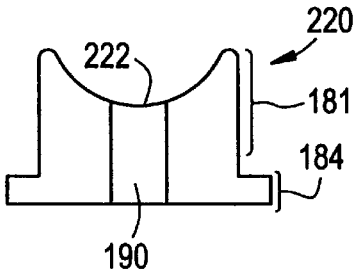
FIG. 28 is an elevational view of a spring retainer of this invention for use in a truck assembly having a curved surface for receiving a shock absorber with a curved surface.
Figure 29:
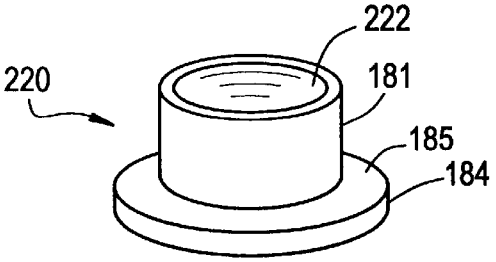
FIG. 29 is a three dimensional elevational view of a spring retainer of this invention for use in a truck assembly having a curved surface for receiving a shock absorber with a curved surface.
Figure 30:
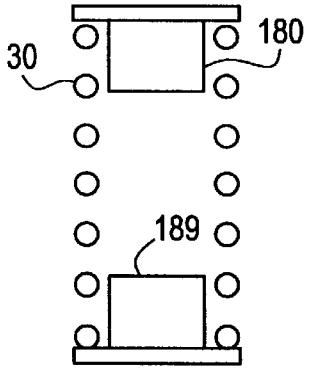
FIG. 30 is a partial view of the ATB truck's spring retainer/spring assembly of this invention.

A still further embodiment of this invention utilizes a shock absorber 230 in the general shape of an egg, oval or ellipse, and which is also made of urethane or other polymeric, rubber or similar material, is used instead of cylindrical absorber 210. In this embodiment, an alternative top hat spring retainer 220, as shown in FIGS. 28 and 29, is provided with an interior surface 222 that is curved or dished out so as to receive complementary curved upper and lower surfaces 232 of egg-shaped shock absorber 230. As shown in FIGS. 36 through 39, the egg-shaped shock absorber 230 is made of an oval or elliptical shape with a middle portion 233 having a relatively gentle curve, and a sharper or more narrow curve at its upper and lower portions 232. A plastic or rubber shock absorber of this design provides the rider with even more balanced and smooth turning, especially when he or she is doing sharp and/or fast turns, than does cylindrical shock absorber 210. The use of the egg-shaped shock absorber 230 results in better turning and a smoother ride because it has m ore engagement with surfaces 232 and thus better containment within between upper and lower spring retainers 220.

Figure 39:
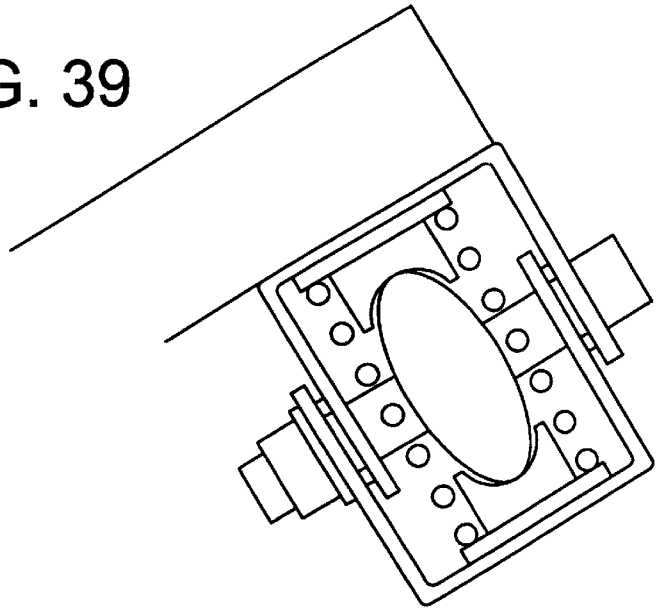
FIG. 39 is a side view of the ATB truck/spring retainer/spring assembly with an oval-shaped shock absorber of FIG. 36 is tilted within the channel of the truck.
Figure 40:
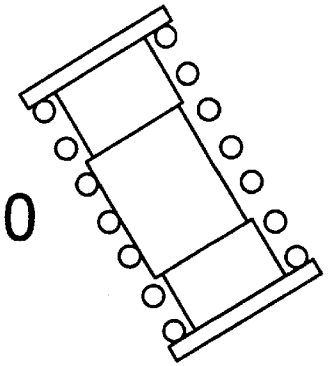
FIG. 40 is a partial side view of the ATB truck's spring retainer/spring assembly wherein a straight cylindrical absorber is tilted between the upper and lower spring retainers.
Figure 38:
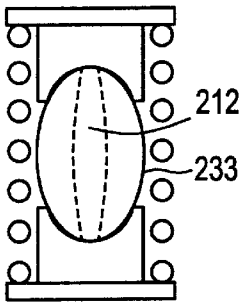
FIG. 38 is a partial view of the ATB truck's spring retainer/spring assembly and oval-shaped shock absorber of FIG. 36 wherein the curved surface shock absorber is compressed between the upper and lower spring retainers during loading of the ATB.
Figure 37:
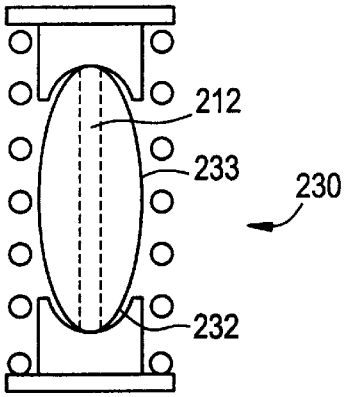
FIG. 37 is a partial view of the ATB truck's spring retainer/spring assembly and oval-shaped shock absorber of FIG. 36 wherein the curved surface shock absorber engages both the upper and lower spring retainers.
Figure 36:
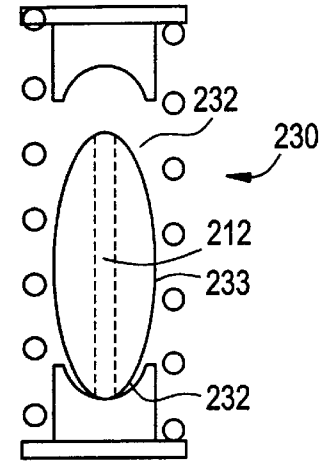
FIG. 36 is a partial view of the ATB truck's spring retainer/spring assembly of this invention having an oval-shaped shock absorber inserted between spring retainers having curved surfaces for receiving the shock absorber.

As shown in FIGS. 36 through 39, the upper and lower curved surfaces 232 of the egg-shape shock absorber 230 fit snugly against the curved surfaces 222 of concave top hat spring retainers 180, in a generally male-female connection. When spring 30 is compressed due to load placed on the ATB during riding, the resulting pressure is quickly displaced along the arched surfaces 232 of upper and lower ends of the shock absorber 230, and the mass of egg-shaped shock absorber increases at about its middle portion 233, as is shown in FIG. 38. This oval or elliptical design thereby results in a more efficient displacement of heavy shock and pressure, such as that encountered when riding an ATB over rough or rocky terrain, and consequently, and in a more smooth and controlled ride on all types of terrain. In addition, when the springs 30 are loaded and compressed, oval-shaped shock absorber 230 stays contained between top hat spring retainers 220 in the interior of the spring 30. This also contributes to a smoother, more controlled ride when turning because there is little or no perception of slipping or loss of control which may occur with flat top cylindrical inserts 210, which can slide within the spring 30 or slip against the flat surface of surface 189 of flat top hat spring retainer 180. It should also result in less deterioration than would be seen with cylindrical insert 210, because the latter moves against the springs during riding. This can be seen with a comparison between FIG. 39, showing a tightly held oval shaped shock absorber/top hat retainer assembly inside channel 61 during turning, and FIG. 40, which shows a cylindrical shock absorber sliding against the flat surface 189 of top hat 180 during turning.

Egg-shaped shock absorber 230 may also, like straight cylindrical absorber 210, contain an interior channel 212 made by conventional molding or milling techniques. As shown in FIG. 38, the presence of a channel 212 running through the interior of egg-shaped absorber 230 expands to provide the truck assembly with a dampening effect during riding, for enhanced control and smoothness.

The sizes and surface dimensions of egg or oval-shaped shock absorber 230 and concave spring retainer 220 may be varied to suit the size and weight of the sport board or other vehicle with which it is to be used. For example, egg-shaped absorber 230 can be about 1.5 inches from the upper to lower end, and about 0.675 inches at its widest point when at rest. Interior channel 212 can be about 0.125 inches in diameter. Also, in one spring retainer embodiment, inner curved surface 222 has a radius of about 0.325 inches, cylindrical portion 182 has a diameter of about 0.75 inches and is about 0.55 inches high; top or rim portion 184 is about 0.125 inches high and has a diameter of about 1.125 inches. Concave spring retainer 220, like the flat spring retainer 180, also has an interior opening or channel 190 therein to receive bolt 192, which secures spring retainer 220 to upper truck portion 58 of upper truck 24, and lower truck portion 68 of lower truck 28 through openings 180 in those truck portions.

While the invention has been described in conjunction with preferred specific embodiments thereof, it will be understood that this description is intended to illustrate and not to limit the scope of the invention, which is defined by the following claims:

I claim:

1. A truck assembly for a sport board or other wheeled apparatus having a frame with a central portion and end portions, comprising:

(a) an upper truck secured to an end portion of said frame having a horizontal upper portion with opposing lateral ends, each lateral end having a spring retention means thereon, and a vertical lower portion extending downward from said upper portion having a front and back walls so as to define a channel in the upper truck and an opening in said front and back walls for a pivot pin;

(b) a lower truck having a vertical upper portion with front and back walls so as to define a channel in the lower truck and an opening through said front and back walls for a pivot pin, said vertical upper portion extending inward to a lower horizontal portion with opposing lateral ends, each lateral end having a spring retention means thereon;

(c) a pivot pin extending through the openings in the walls of the upper and lower trucks to secure the upper and lower trucks together; and (d) one or more vertically positioned coiled springs having two opposite ends, one end in engagement with the spring retention means on the upper truck, and the other end in engagement with the spring retention means on the lower truck, and (e) wherein the shock absorber is placed within the interior of the spring coil between the spring retention means.

2. A truck assembly as in claim 1 wherein the shock absorber is a cylinder.

3. A truck assembly as in claim 1 wherein the shock absorber is rectangular.

4. A truck assembly as in claim 1 wherein the shock absorber comprises at least one upper or lower curved surface.

5. A truck assembly as in claim 1 wherein the shock absorber comprises an oval shape.

6. A truck assembly as in claim 1 wherein the shock absorber comprises a spherical shape.

7. A sport board for riding on all forms of land terrain comprising:

(a) a frame having a central portion parallel to the terrain;

(b) a front end portion extending from the central portion;

(c) a rear end portion extending form the central portion;

(d) a deck mounted onto the central portion of the frame and parallel to the terrain;

(e) an upper truck secured to at least one end portion of said frame having a horizontal upper portion with opposing lateral ends, each lateral end having a spring retention means thereon, and a vertical lower portion extending downward from said upper portion having front and back walls so as to define a channel in the upper truck and an opening in said front and back walls for a pivotal pin;

(f) a lower truck having a vertical upper portion with front and back walls so as to define a channel in the lower truck and an opening through said front and back walls for a pivot pin, said upper portion extending downward to a lower horizontal portion with opposing lateral ends, each lateral end having a spring retention means thereon;

(g) a pivot pin extending through the openings in the walls of the upper and lower trucks to secure them together;

(h) one or more vertically positioned coiled springs having two opposite ends, one end in engaging with the spring retention means on the upper truck and the other end in engagement with the spring retention means on the lower truck;

(i) an axle having opposite ends, said axle being secured to the upper or lower truck; and (j) wheels rotatably mounted on the opposite end of the axle, whereby when the rider of the board tips one side of the deck downwards the upper and lower trucks rotate relative to each other about the pivot pin enabling the sport board to turn in the direction of the downward side of the board, and (k) further comprising the shock absorber situated within the interior of the spring coil.

8. A sport board as in claim 7 wherein the shock absorber is cylindrical.

9. A sport board as in claim 7 wherein the shock absorber is oval.

* * * * *